US009752563B2

(12) United States Patent
Yamamoto et al.

(10) Patent No.: US 9,752,563 B2
(45) Date of Patent: Sep. 5, 2017

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Shinya Yamamoto, Aichi-ken (JP); Yusuke Yamazaki, Aichi-ken (JP); Hiroyuki Nakaima, Aichi-ken (JP); Kengo Sakakibara, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 358 days.

(21) Appl. No.: 14/533,475

(22) Filed: Nov. 5, 2014

(65) Prior Publication Data

US 2015/0125317 A1 May 7, 2015

(30) Foreign Application Priority Data

Nov. 6, 2013 (JP) ..... 2013-230006

(51) Int. Cl.
*F04B 1/29* (2006.01)
*F04B 27/18* (2006.01)
*F04B 27/10* (2006.01)

(52) U.S. Cl.
CPC ..... *F04B 1/295* (2013.01); *F04B 27/1054* (2013.01); *F04B 27/1063* (2013.01);
(Continued)

(58) Field of Classification Search
None
See application file for complete search history.

(56) References Cited

U.S. PATENT DOCUMENTS 4,037,993 A 7/1977 Roberts
4,061,443 A * 12/1977 Black ..... F04B 27/1072 184/6.17

(Continued)

FOREIGN PATENT DOCUMENTS

EP 1167759 1/2002
EP 2045467 4/2009

(Continued)

OTHER PUBLICATIONS

Extended European Search Report for EP 14190603.2 dated May 4, 2015.

*Primary Examiner* — Peter J Bertheaud
*Assistant Examiner* — Geoffrey Lee
(74) *Attorney, Agent, or Firm* — Greenblum & Bernstein, P.L.C.

(57) ABSTRACT

A swash plate type variable displacement compressor according to the present invention includes a housing having a suction chamber, a discharge chamber, a swash plate chamber, and a plurality of cylinder bores, a drive shaft, a swash plate, a link mechanism, a plurality of pistons reciprocally received in the respective cylinder bores, a conversion mechanism, an actuator that changes the inclination angle of the swash plate, and a control mechanism that controls the actuator. The link mechanism disposed between the drive shaft and the swash plate allows a change in inclination angle of the swash plate with respect to a plane extending perpendicularly to the axis of rotation of the drive shaft. The conversion mechanism converts the rotation of the swash plate into reciprocal movement of the pistons in the cylinder bores with a stroke length according to the inclination angle of the swash plate.

10 Claims, 8 Drawing Sheets

(52) U.S. Cl.
CPC ..... *F04B 27/1072* (2013.01); *F04B 27/1804* (2013.01); *F04B 2027/1813* (2013.01); *F04B 2027/1831* (2013.01)

(56) References Cited

U.S. PATENT DOCUMENTS

| | | | | | |
|---|---|---|---|---|---|
| 4,145,163 | A * | 3/1979 | Fogelberg | F04B 27/1063 | 417/222.1 |
| 4,174,191 | A * | 11/1979 | Roberts | F04B 27/18 | 417/222.1 |
| 4,586,874 | A * | 5/1986 | Hiraga | F04B 27/08 | 417/222.2 |
| 5,000,666 | A * | 3/1991 | Esaki | F04B 27/18 | 417/222.2 |
| 5,055,004 | A * | 10/1991 | Ebbing | F04B 27/1804 | 417/222.2 |
| 5,079,996 | A * | 1/1992 | Abousabha | F04B 1/324 | 417/222.1 |
| 5,105,728 | A * | 4/1992 | Hayase | F04B 27/1072 | 417/222.2 |
| 5,259,736 | A | 11/1993 | Terauchi | | |
| 5,370,503 | A | 12/1994 | Terauchi | | |
| 5,577,894 | A * | 11/1996 | Kawaguchi | F04B 27/1804 | 417/222.2 |
| 5,624,240 | A * | 4/1997 | Kawaguchi | B60H 1/3222 | 417/222.2 |
| 5,762,476 | A * | 6/1998 | Ota | F04B 27/1804 | 417/222.2 |
| 6,102,669 | A * | 8/2000 | Fujita | F04B 27/0895 | 417/222.1 |
| 6,416,297 | B1 * | 7/2002 | Kawaguchi | F04B 27/1063 | 417/222.2 |
| 6,742,439 | B2 | 6/2004 | Matsuda et al. | | |
| 6,957,604 | B1 * | 10/2005 | Tiedemann | F04B 1/295 | 417/222.1 |
| 2008/0063540 | A1 * | 3/2008 | Inoue | F04B 27/1081 | 417/222.2 |
| 2008/0226471 | A1 * | 9/2008 | Yokomachi | F04B 27/109 | 417/222.1 |
| 2009/0220354 | A1 * | 9/2009 | Kimoto | F04B 27/1009 | 417/222.1 |
| 2012/0073430 | A1 | 3/2012 | Uchikado | | |
| 2013/0094941 | A1 * | 4/2013 | Hashimoto | F04B 27/14 | 415/119 |
| 2015/0104334 | A1 * | 4/2015 | Ota | F04B 27/18 | 417/222.2 |
| 2015/0267692 | A1 * | 9/2015 | Yamamoto | F04B 27/1804 | 417/218 |
| 2016/0153435 | A1 * | 6/2016 | Nakaima | F04B 27/1054 | 417/270 |
| 2016/0153437 | A1 * | 6/2016 | Nakaima | F04B 27/1054 | 417/222.1 |
| 2016/0222953 | A1 * | 8/2016 | Yamamoto | F04B 27/1063 | |
| 2016/0237994 | A1 * | 8/2016 | Sakakibara | F04B 27/18 | |

FOREIGN PATENT DOCUMENTS

| | | |
|---|---|---|
| EP | 2093423 | 8/2009 |
| JP | 52-131204 | 11/1977 |
| JP | 58-162780 | 9/1983 |
| JP | 61-145379 | 7/1986 |
| JP | 62-225782 | 10/1987 |
| JP | 64-41680 | 2/1989 |
| JP | 01-147171 | 6/1989 |
| JP | 02-16374 | 1/1990 |
| JP | 02-19665 | 1/1990 |
| JP | 03-10082 | 1/1991 |
| JP | 04-54287 | 2/1992 |
| JP | 05-18355 | 1/1993 |
| JP | 05-172052 | 7/1993 |
| JP | 05-312144 | 11/1993 |
| JP | 2002-349431 | 12/2002 |
| JP | 2003-507627 | 2/2003 |
| JP | 2007-239722 | 9/2007 |
| JP | 2009-257150 | 11/2009 |
| JP | 2010-281289 | 12/2010 |

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Unexamined Patent Application Publication No. 52-131204 discloses a swash plate type variable displacement compressor (hereinafter, referred to as compressor). The compressor includes a housing having therein a suction chamber, a discharge chamber, a swash plate chamber, and a plurality of cylinder bores. A drive shaft is rotatably supported in the housing. The swash plate chamber accommodates therein a swash plate that is rotatable with the drive shaft. The swash plate has a circular shape and has an insertion hole at the center thereof. A link mechanism that allows a change in the inclination angle of the swash plate is disposed between the drive shaft and the swash plate. The inclination angle herein refers to an angle of the swash plate with respect to a plane extending perpendicular to the rotational axis of the drive shaft.

Each cylinder bore accommodates a reciprocally movable piston and thus forms a compression chamber with the piston. A conversion mechanism is provided that converts the rotation of the swash plate into reciprocal movement of each piston in its associated cylinder bore with a stroke length corresponding to the inclination angle of the swash plate. The compressor further includes an actuator that changes the inclination angle of the swash plate and a control mechanism that controls the actuator.

The link mechanism includes a lug member and an arm. The lug member is fixed on the drive shaft in the swash plate chamber on the front side of the swash plate. The arm is swingably connected to the lug member and the swash plate through a connecting pin. The arm transmits the rotation of the lug member to the swash plate and allows a change in the inclination angle of the swash plate while the top dead center position of the swash plate being maintained.

The actuator includes the lug member and a movable body that is integrally rotatably engaged with the swash plate and moves in the direction of the axis of rotation so as to change the inclination angle of the swash plate. Specifically, the lug member has a columnar shape and is concentric with the axis of rotation and a cylinder chamber in which the movable body is movable. The cylinder chamber is defined by the movable body to thereby form a pressure control chamber and the movable body is moved by the pressure in the pressure control chamber. The swash plate has in the insertion hole thereof a hinge ball. The hinge ball is mounted on the swash plate to allow the swash plate to pivot about the drive shaft. The rear end of the movable body is in contact with the hinge ball. A pressing spring is provided on the rear side of the hinge ball for urging the hinge ball in the direction that increases the inclination angle of the swash plate.

The control mechanism includes a control passage and a control valve. The control passage includes a pressure-changing passage that is in communication with the pressure control chamber, a low-pressure passage that is in communication with the suction chamber and the swash plate chamber, and a high-pressure passage that communicates with the discharge chamber. A part of the pressure-changing passage is formed in the drive shaft. The control valve controls the opening of the pressure-changing passage, the low-pressure passage, and the high-pressure passage. In other words, the control valve provides communication between the pressure-changing passage and the low-pressure passage or between the pressure-changing passage and the high-pressure passage.

In the compressor, when the communication between the pressure-changing passage and the high-pressure passage is allowed through the control valve, the pressure in the pressure control chamber becomes higher than that of the swash plate chamber. This causes the movable body of the actuator to move away from the lug member and presses the hinge ball rearward in the swash plate chamber. As a result, the inclination angle of the swash plate is reduced to reduce the stroke length of the pistons and hence the displacement of the compressor. When the communication between the pressure-changing passage and the low-pressure passage is allowed through the control valve, on the other hand, the pressure in the pressure control chamber is lowered to a level almost equal to the pressure level of the pressure in the swash plate chamber. This causes the movable body of the actuator to move toward the lug member. The urging force of the pressing spring acts on the hinge ball to move the hinge ball following the movable body, which increases the inclination angle of the swash plate. Accordingly, the stroke length of the pistons and hence the displacement of the compressor is increased. When the inclination angle of the swash plate is maximum, the swash plate is in contact with the rear end of the lug member.

In order to ensure a high controllability of the compressor, the swash plate may have a balancing weight for controlling the inertia generated by the rotation of the swash plate. Such balancing weight may extend in the direction that is opposite to the position of the top dead center of the swash plate, i.e., extend from the swash plate side toward the lug member side.

In this configuration, when the inclination angle of the swash plate is maximum, the balancing weight is in contact with the rear end of the lug member, which means that the compressor needs to be longer in the axial direction.

The present invention, which has been made in view of the circumstances above, and is directed to providing a swash plate type variable displacement compressor that is small in size and ensures a high controllability.

SUMMARY OF THE INVENTION

A swash plate type variable displacement compressor according to the present invention includes a housing having therein a suction chamber, a discharge chamber, a swash plate chamber, and a plurality of cylinder bores, a drive shaft rotatably supported in the housing and having an axis of rotation, a swash plate that is rotatable in the swash plate chamber with the drive shaft, a link mechanism, a plurality of pistons, a conversion mechanism, an actuator, and a control mechanism. The link mechanism is disposed between the drive shaft and the swash plate and allows a change in inclination angle of the swash plate with respect to a plane extending perpendicularly to the axis of rotation of the drive shaft. The pistons are reciprocally movably received in the respective cylinder bores. The conversion mechanism converts the rotation of the swash plate into reciprocal movement of the pistons in the respective cylinder bores with a stroke length according to the inclination angle of the swash plate. The actuator changes the inclination angle of the swash plate. The control mechanism controls the actuator. The actuator includes a lug member that is fixed on the drive shaft in the swash plate chamber that is opposed to the swash plate, and a movable body disposed between the lug member and the swash plate. The lug member has an insertion hole through which the drive shaft is inserted, and a cylinder chamber that is recessed from the swash plate side of the lug member in such a manner as to surround the insertion hole. The movable body is movable in the cylinder chamber in the direction of the axis of rotation. A pressure control chamber is formed between the cylinder chamber and the movable body and moves the movable body with pressure in the pressure control chamber. The swash plate has a balancing weight on the side opposite to the link mechanism. The cylinder chamber has an accommodating chamber that is opened toward the swash plate as the movable body moves in the direction that reduces the volume of the pressure control chamber with an increase in the inclination angle of the swash plate. At least a part of the balancing weight is inserted in the accommodating chamber when the inclination angle of the swash plate is maximum.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the embodiments together with the accompanying drawings in which.

DETAILED DESCRIPTION OF THE EMBODIMENTS

First to fourth embodiments of the present invention will now be described with reference to the drawings. Compressors of the first to fourth embodiments are swash plate type variable displacement compressors of a single head type. Each of the compressors is mounted on a vehicle and forms a part of a refrigeration circuit in an air conditioning system of the vehicle.

First Embodiment

Figure 1:
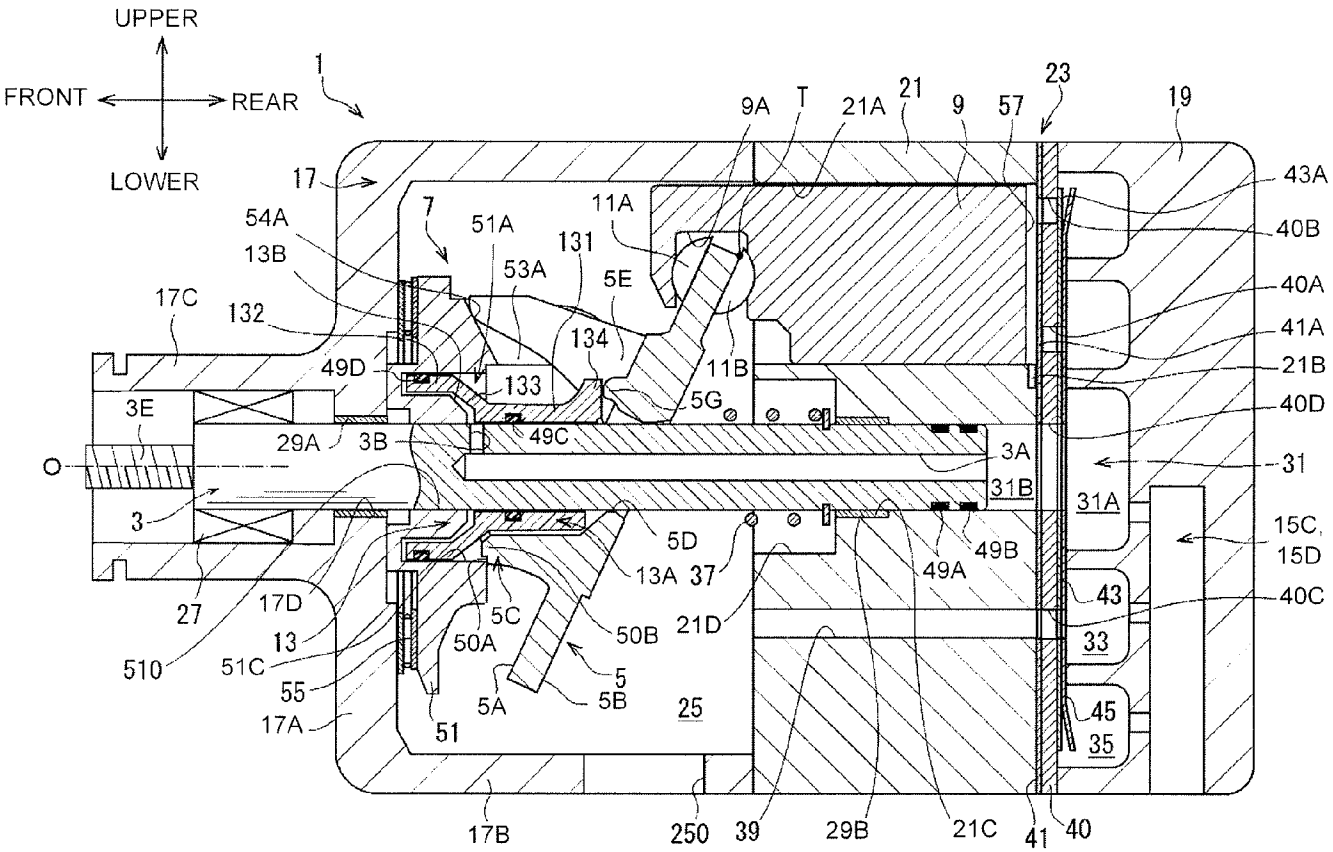
FIG. 1 is a longitudinal sectional view of a compressor according to a first embodiment of the present invention in a state corresponding to the maximum displacement.
Figure 2:
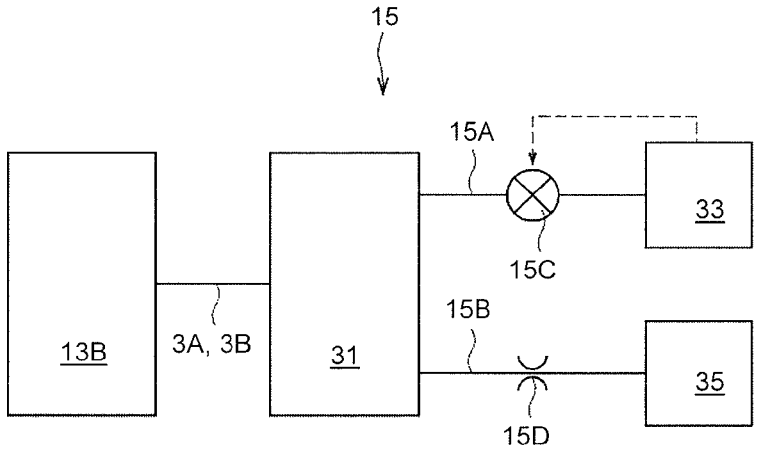
FIG. 2 is a schematic diagram showing a control mechanism of the compressor according to the first embodiment.

Referring to FIGS. 1 and 2, a compressor according to the first embodiment of the present invention includes a housing 1, a drive shaft 3, a swash plate 5, a link mechanism 7, a plurality of pistons 9, pairs of shoes 11A, 11B, an actuator 13, and a control mechanism 15. It is to be noted that the illustration of the swash plate 5 and other components in FIG. 1 is simplified for the ease of explanation and the same applies to FIGS. 5, 6, 9, and 10 to be described later.

Referring to FIG. 1, the housing 1 includes a front housing 17, a rear housing 19, a cylinder block 21 disposed between the front housing 17 and the rear housing 19, and a valve unit 23.

The front housing 17 has a front wall 17A extending vertically in the front of the compressor, a peripheral wall 17B formed integrally with and extending rearward from the front wall 17A. The front wall 17A and the peripheral wall 17B cooperate to form the front housing 17 of a substantially cylindrical shape with a closed end. The front wall 17A and the peripheral wall 17B cooperate to form a swash plate chamber 25 in the front housing 17.

The front wall 17A has a boss 17C formed extending forward from the front wall 17A. A shaft sealing device 27 is provided in the boss 17C. The boss 17C has a first shaft hole 17D extending in the longitudinal direction of the compressor. The first shaft hole 17D has therein a first sliding bearing 29A.

The peripheral wall 17B of the front housing 17 has therethrough a suction port 250 that communicates with the swash plate chamber 25. The swash plate chamber 25 is connected to an external evaporator (not shown) through the suction port 250.

A part of the control mechanism 15 is formed in the rear housing 19. The rear housing 19 also has therein a first pressure regulation chamber 31A, a suction chamber 33, and a discharge chamber 35. The first pressure regulation chamber 31A is disposed at the center of the rear housing 19. The discharge chamber 35 has an annular shape and is disposed in the rear housing 19 at a position adjacent to the outer periphery of the rear housing 19. The suction chamber 33 has an annular shape and is disposed in the rear housing 19 between the first pressure regulation chamber 31A and the discharge chamber 35. The discharge chamber 35 is connected to an external refrigeration circuit through a discharge port (not shown).

A plurality of cylinder bores 21A is formed through the cylinder block 21 around the drive shaft 3 at an equal angular interval. The number of the cylinder bores 21A corresponds to the number of the pistons 9. Each cylinder bore 21A communicates at the front end thereof with the swash plate chamber 25. A retaining groove 21B is formed in the cylinder block 21 that regulates the maximum opening of a suction reed valve 41A, which will be described later.

A second shaft hole 21C is formed through the cylinder block 21, extending in the longitudinal direction of the compressor. The second shaft hole 21C communicates with the swash plate chamber 25. The second shaft hole 21C has therein a second sliding bearing 29B. The cylinder block 21 has a spring chamber 21D. The spring chamber 21D is disposed between the swash plate chamber 25 and the second shaft hole 21C. A return spring 37 is arranged in the spring chamber 21D. When the inclination angle of the swash plate 5 is minimum, the return spring 37 urges the swash plate 5 forward in the swash plate chamber. The cylinder block 21 further has therein a suction passage 39 that communicates with the swash plate chamber 25.

The valve unit 23 is disposed between the rear housing 19 and the cylinder block 21. The valve unit 23 includes a valve plate 40, a suction valve plate 41, a discharge valve plate 43, and a retaining plate 45.

A suction hole 40A is formed through the valve plate 40, the discharge valve plate 43, and the retaining plate 45 for each cylinder bore 21A. A discharge hole 40B is formed through the valve plate 40 and the suction valve plate 41 for each cylinder bore 21A. Each cylinder bore 21A is communicable with the suction chamber 33 through the associated suction hole 40A and also with the discharge chamber 35 through the associated discharge hole 40B. A first communication hole 40C and a second communication hole 40D are formed through the valve plate 40, the suction valve plate 41, the discharge valve plate 43, and the retaining plate 45. The first communication hole 40C provides fluid communication between the suction chamber 33 and the suction passage 39.

The suction valve plate 41 is provided on the front surface of the valve plate 40. The aforementioned plurality of suction reed valve 41A is formed in the suction valve plate 41. The suction reed valves 41A are elastically deformable to open and close the suction holes 40A. The discharge valve plate 43 is provided on the rear surface of the valve plate 40. A plurality of discharge reed valves 43A is formed in the discharge valve plate 43. The discharge reed valves 43A are elastically deformable to open and close the discharge hole 40B. The retainer plate 45 is provided on the rear surface of the discharge valve plate 43 and regulates the maximum opening of the discharge reed valves 43A.

The drive shat 3 is passed rearward through the boss 17C in the housing 1. The drive shaft 3 is inserted in the shaft sealing device 27 in the boss 17C. The front end of the drive shaft 3 is supported by the first sliding bearing 29A in the boss 17C. The rear end of the drive shaft 3 is supported by the second sliding bearing 29B in the second shaft hole 21C. Thus, the drive shaft 3 is supported rotatably about the axis of rotation O relative to the housing 1. A second pressure regulation chamber 31B is defined in the second shaft hole 21C by the rear end of the drive shaft 3. The second pressure regulation chamber 31B is in communication with the first pressure regulation chamber 31A through the second communication hole 40D. The first and second pressure regulation chambers 31A, 31B cooperate to form the pressure regulation chamber 31.

The drive shaft 3 has at the rear end thereof O-rings 49A, 49B that seal a pressure regulation chamber 31 and to thereby block the communication between the swash plate chamber 25 and the pressure regulation chamber 31.

Figure 3:
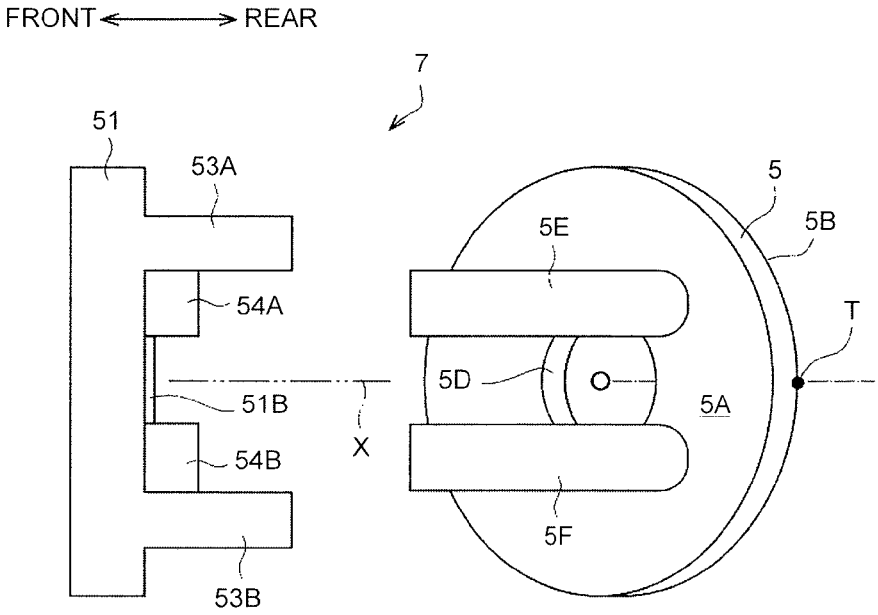
FIG. 3 is a top view schematically showing a link mechanism and its related components of the compressor according to the first embodiment.

The link mechanism 7, the swash plate 5, and the actuator 13 are mounted on the drive shaft 3. As shown in FIG. 3, the link mechanism 7 includes a lug plate 51 having first and second drive arms 53A, 53B formed extending from the lug plate 51, and first and second swash plate arms 5E, 5F that are formed extending from the swash plate 5. The lug plate 51 corresponds to the lug member of the present invention. It is to be noted that any appropriate mechanism may be used for the link mechanism 7.

As shown in FIG. 1, the lug plate 51 having at the center thereof an insertion hole 510 has a substantially annular shape. The drive shaft 3 is press-fitted in the insertion hole 510 of the lug plate 51 so that the lug plate 51 and the drive shaft 3 are integrally rotatable. The lug plate 51 is disposed in the swash plate chamber 25 at the front end thereof and frontward of the swash plate 5. The lug plate 51 and the swash plate 5 are opposed to each other in the swash plate chamber 25. A thrust bearing 55 is provided between the lug plate 51 and the front wall 17A of the front housing 17.

The lug plate 51 has a cylinder chamber 51A that is recessed from the rear end surface of the lug plate 51 in such a manner as to surround the insertion hole 510. The cylinder chamber 51A extends in the lug plate 51 to a position that is radially inward of the thrust bearing 55. The cylinder chamber 51A is coaxial with the insertion hole 510 and disposed at the center of the lug plate 51.

As shown in FIG. 3, the first and second drive arms 53A, 53B of the lug plate 51 extend rearward. The first drive arm 53A and the second drive arm 53B are formed extending from the lug plate 51 in a pair across an imaginary plane of a top dead center X passing through the top dead center position T of the swash plate 5 and the axis of rotation O of the drive shaft 3.

Furthermore, the lug plate 51 has first and second slide surfaces 54A, 54B at positions between the first and second drive arms 53A, 53B. Each of the first and second slide surfaces 54A, 54B has a substantially rectangular shape that extends from a radially outward position in the lug plate 51 toward the cylinder chamber 51A, that is, from the radially outward position toward the center of the cylinder chamber 51A. The first and second slide surfaces 54A, 54B are also formed in a pair across the plane of the top dead center X. The first slide surface 54A is formed on the first drive arm 53A side of the lug plate 51 and the second slide surface 54B on the second drive arm 53B side. As shown in FIG. 1, the first and second slide surfaces 54A, 54B are formed so as to be inclined downwardly toward the center of the cylinder chamber 51A. Furthermore, as shown in FIG. 3, the lug plate 51 has a raised surface 51B that is raised rearward between the first slide surface 54A and the second slide surface 54B.

Figure 4:
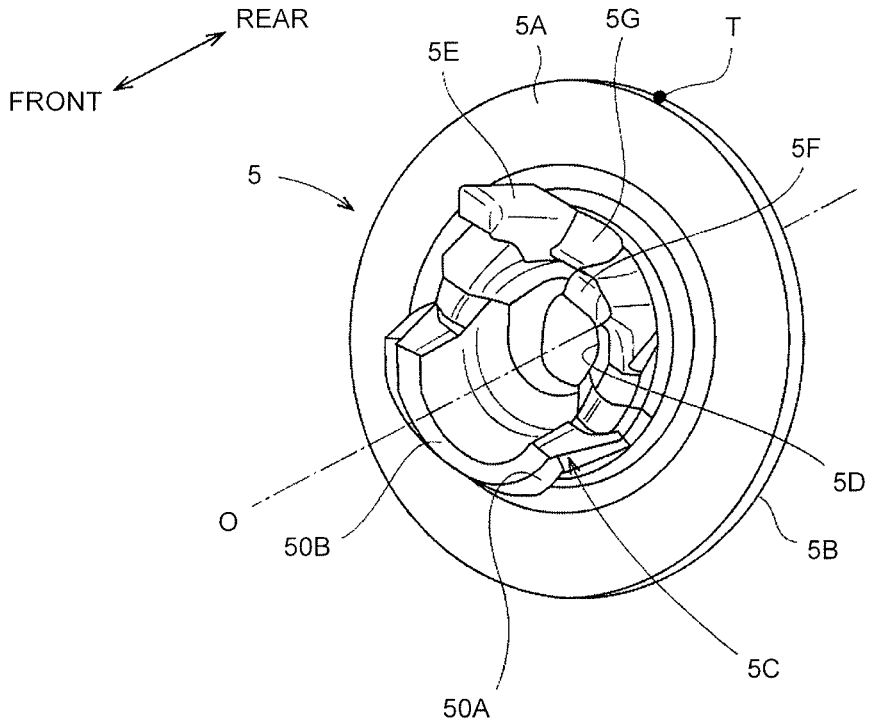
FIG. 4 is a perspective view showing the front of the swash plate of the compressor according to the first embodiment.

As shown in FIG. 4, the planar, circular swash plate 5 has a front surface 5A and a rear surface 5B. The front surface 5A has a balancing weight, 5C that projects frontward from the front surface 5A of the swash plate 5 and controls the inertia generated by the rotation of the swash plate 5. The swash plate 5 has at the center thereof an insertion hole 5D, through which the drive shaft 3 is passed.

The balancing weight 5C has a substantially semi-circular cross section taken in the direction perpendicular to the axial direction of the swash plate 5. The balancing weight 5C is disposed at a position that is adjacent to the insertion hole 5D and opposite to the top dead center position T of the swash plate 5 with respect to the axis of rotation O. As shown in FIG. 1, with the drive shaft 3 inserted through the insertion hole 5D of the swash plate 5, the balancing weight 5C is located at a position that is adjacent to the drive shaft 3 and opposite to the link mechanism 7 with respect to the axis of rotation O.

Furthermore, as shown in FIG. 4, the balancing weight 5C has at the front end thereof a restricting surface 50A which is brought into contact with the lug plate 51 when the inclination angle of the swash plate 5 becomes maximum. The balancing weight 5C has a portion which is radially inward of the restricting surface 50A and projects frontward of the restricting surface 50A. Such projecting part serves as an entry part 50B that enters an accommodating chamber 51C which will be described later. As described above, the restricting surface 50A is brought into contact with the lug plate 51 without entering the accommodating chamber 51C. The restricting surface 50A corresponds to the non-entry part of the present invention.

Referring to FIG. 3, the first and second swash plate arms 5E, 5F are formed extending frontward from the front surface 5A of the swash plate 5. The first and second swash plate arms 5E, 5F are also formed in a pair across the plane of the top dead center X. It is to be noted that configurations of the balancing weight 5C and a projecting part 5G, which will be described later, and other components are omitted from the illustration in FIG. 3 for ease of explanation.

As shown in FIG. 4, the first and second swash plate arms 5E, 5F are provided in a pair located on the top dead center position T side of the swash plate 5 and in facing relation to the balancing weight 5C across the axis of rotation O. The first and second swash plate arms 5E, 5F face the balancing weight 5C across the axis of rotation O.

Furthermore, the aforementioned projecting part 5G is formed projecting from the front surface 5A of the swash plate 5. The projecting part 5G is disposed between the first swash plate arm 5E and the second swash plate arm 5F and has a substantially hemispherical shape.

The swash plate 5 is mounted on the drive shaft 3 while inserting the first and second swash plate arms 5E, 5F of the swash plate 5 between the first and second drives arms 53A, 53B of the lug plate 51. In this case, the raised surface 51B of the lug plate 51 is located between the first swash plate arm 5E and the second swash plate arm 5F of the swash plate 5. Specifically, the lug plate 51 and the swash plate 5 are connected with the first and second swash plate arms 5E, 5F with the swash plate arms 5E, 5F disposed between the first and second drive arms 53A, 53B. The first and second drive arms 53A, 53B transmit the rotation of the drive shaft 3 to the first and second swash plate arms 5E, 5F, thus driving the swash plate 5 to rotate in the swash plate chamber 25 with the lug plate 51.

In the structure wherein the first and second swash plate arms 5E, 5F are located between the first and second drive arms 53A, 53B, the end of the first swash plate arm 5E is in slide contact with the first slide surface 54A and the end of the second swash plate arm 5F is in slide contact with the second slide surface 54B, respectively. With this configuration, the swash plate 5 is allowed to change the inclination angle with respect to the direction perpendicular to the axis of rotation O from the maximum angle shown in FIG. 1 to the minimum angle shown in FIG. 5, while maintaining the top dead center position T of the swash plate 5.

As shown in FIG. 1, the actuator 13 includes the lug plate 51, the movable body 13A, and a pressure control chamber 13B.

The movable body 13A is mounted on the drive shaft 3 so as to be slidable in the direction of the axis of rotation O while being in slide contact with the drive shaft 3. The movable body 13A has a cylindrical shape that is coaxial with the drive shaft 3. Specifically, the movable body 13A has a diameter that is smaller than that of the thrust bearing 55 and includes a first cylindrical part 131, a second cylindrical part 132, and a connecting part 133. The first cylindrical part 131 forms a rear part of the movable body 13A that is adjacent to the swash plate 5. The first cylindrical part 131 extends in the axial direction of the movable body 13A and has the smallest diameter in the movable body 13A. The second cylindrical part 132 forms a front part of the movable body 13A and extends in the axial direction of the movable body 13A. The second cylindrical part 132 has a diameter that is larger than diameter of the first cylindrical part 131 and the largest in the movable body 13A. The connecting part 133 is formed such that the diameter is gradually increased toward the front. The connecting part 133 connects the first cylindrical part 131 and the second cylindrical part 132.

The balancing weight 5C is formed in conformity with the connecting part 133. Specifically, the front end part of the balancing weight 5C is formed such that the diameter of the balancing weight 5C is increased toward the front.

An acting part 134 is formed integrally with the movable body 13A at the rear end of the first cylindrical part 131 thereof. The acting part 134 extends radially outward or perpendicularly to the axis of rotation O and toward the top dead center position T of the swash plate 5 so as to be in point contact with the projecting part 5G of the swash plate 5. With this configuration, the movable body 13A is integrally rotatable with the lug plate 51 and the swash plate 5.

The movable body 13A is slidable in the cylinder chamber 51A in the direction of the axis of rotation O. With the front end of the movable body 13A moved into the cylinder chamber 51A, the movable body 13A may be fitted in the lug plate 51. In the state in which the front end of the movable body 13A has moved as far as it can go into the cylinder chamber 51A, the second cylindrical part 132 reaches a position that is just radially inward of the thrust bearing 55 in the cylinder chamber 51A.

The movable body 13A defines the pressure control chamber 13B in the cylinder chamber 51A. More specifically, the pressure control chamber 13B is defined in the cylinder chamber 51A by the second cylindrical part 132, the connecting part 133 of the movable body 13A, and the drive shaft 3. The space in the cylinder chamber 51A other than the pressure control chamber 13B is the accommodating chamber 51C. The accommodating chamber 51C is opened to the swash plate chamber 25. The ratio in volume between the pressure control chamber 13B and the accommodating chamber 51C varies with the sliding of the movable body 13A in the cylinder chamber 51A in the direction of the axis of rotation O. The pressure control chamber 13B is sealed by the O-rings 49C, 49D provided in the outer periphery of the first cylindrical part 131 and the second cylindrical part 132, respectively. Therefore, the pressure control chamber 13B is shut off from fluid communication with the accommodating chamber 51C and the swash plate chamber 25.

The drive shaft 3 has therein an axial passage 3A extending from the rear end to the front end of the drive shaft 3 in the direction of the axis of rotation O and a radial passage 3B extending in the radial direction from the front end of the axial passage 3A of the drive shaft 3 and is opened through the outer peripheral surface of the drive shaft 3. The rear end of the axial passage 3A is opened to the pressure regulation chamber 31, and the radial passage 3B is opened to the pressure control chamber 13B. The provision of the axial passage 3A and the radial passage 3B in the drive shaft 3 provides fluid communication between the pressure regulation chamber 31 and the pressure control chamber 13B.

The drive shaft 3 has at the front end thereof a threaded shaft portion 3E. The drive shaft 3 is connected to a pulley or an electromagnetic clutch (neither is shown) at the threaded shaft portion 3E.

The pistons 9 are reciprocally slidably received in the respective cylinder bores 21A. Each cylinder bore 21A has therein a compression chamber 57 formed with the piston 9 and the valve unit 23.

Each piston 9 has therein a recessed engaging part 9A. The aforementioned pair of hemispherical shoes 11A, 11B is received in the engaging part 9A. The shoes 11A, 11B convert the rotation of the swash plate 5 into the reciprocal movement of the pistons 9 in the respective cylinder bores 21A. The shoes 11A, 11B correspond to the conversion mechanism of the present invention. Each piston 9 is reciprocable in its corresponding cylinder bore 21A with a stroke length according to the inclination angle of the swash plate 5.

As shown in FIG. 2, the control mechanism 15 includes a low-pressure passage 15A, a high-pressure passage 15B, a control valve 15C, an orifice 15D, the aforementioned axial and radial passages 3A, 3B of the drive shaft 3. The low-pressure passage 15A, the high-pressure passage 15B, the axial passage 3A, and the radial passage 3B correspond to the control passages of the present invention. The axial passage 3A and the radial passage 3B also function as the pressure-changing passages.

The low-pressure passage 15A is connected at one end thereof to the pressure regulation chamber 31 and at the other end thereof to the suction chamber 33. The pressure control chamber 13B, the pressure regulation chamber 31, and the suction chamber 33 communicate with each other through the low-pressure passage 15A, the axial passage 3A, and the radial passage 3B. The high-pressure passage 15B is connected at one end thereof to the pressure regulation chamber 31 and at the other end thereof the discharge chamber 35. The pressure control chamber 13B, the pressure regulation chamber 31, and the discharge chamber 35 communicate with each other through the high-pressure passage 15B, the axial passage 3A, and the radial passage 3B. The orifice 15D is provided in the high-pressure passage 15B.

The control valve 15C is provided in the low-pressure passage 15A and controls the opening of the low-pressure passage 15A based on the pressure in the suction chamber 33.

The suction port 250 of the compressor of FIG. 1 is connected to the aforementioned evaporator through a tube and the discharge port is connected to a condenser in the external refrigeration circuit through a tube. The condenser is connected to the evaporator through a tube and an expansion valve. The compressor, the evaporator, the expansion valve, the condenser and the like cooperate to form the refrigeration circuit of a vehicle air conditioning system. It is to be noted that the evaporator, the expansion valve, the condenser and the tubes are omitted from illustration in the drawings.

In the compressor having the above-described configuration, the drive shaft 3 drives to rotate the swash plate 5, thus causing the pistons 9 to reciprocate in the respective cylinder bores 21A. This changes the volume of each compression chamber 57 in accordance with the stroke length of the pistons 9. The refrigerant gas that is drawn from the evaporator into the swash plate chamber 25 through the suction port 250 is flowed into the suction chamber 33 through the suction passage 39 and then into the compression chamber 57 through the suction hole 40A for compression of the refrigerant gas. The refrigerant gas compressed in the compression chamber 57 is discharged into the discharge chamber 35 through the discharge hole 40B and then delivered to the condenser through the discharge port. The balancing weight 5C controls the inertia generated by the rotation of the swash plate 5.

During this compressing operation of the compressor, the compression reaction force of the pistons 9 acts on the swash plate 5 and the lug plate 51 in the direction that reduces the inclination angle of the swash plate 5. A change in the inclination angle of the swash plate 5 changes the stroke of the pistons 9 thereby to vary the displacement of the compressor.

Specifically, when the opening of the low-pressure passage 15A is increased by the control valve 15C shown in FIG. 2, the pressure in the pressure regulation chamber 31 and hence the pressure in the pressure control chamber 13B become substantially the same as the pressure in the suction chamber 33. As a result, as shown in FIG. 1, the volume of the pressure control chamber 13B of the actuator 13 is decreased due to the compression force of the piston 9 acting on the swash plate 5, and the movable body 13A slides in the cylinder chamber 51A in the direction of the axis of rotation O toward the lug plate 51. Accordingly, the volume of the accommodating chamber 51C in the cylinder chamber 51A increases.

Upon receiving the compression reaction force from the piston 9 and the urging force of the return spring 37, the swash plate 5 is moved in such a way that its first swash plate arm 5E slides radially outward on the first slide surface 54A away from the axis of rotation O. Similarly, the second swash plate arm 5F of the swash plate 5 slides radially outward on the second slide surface 54B away from the axis of rotation O.

Therefore, the bottom dead center part of the swash plate 5 rotates clockwise as viewed in FIG. 1, while the top dead center position T being maintained, which increases the inclination angle of the swash plate 5 with respect to the axis of rotation O of the drive shaft 3. Therefore, the stroke length of the pistons 9 increases and accordingly the displacement of the compressor 1 per one rotation of the drive shaft 3 increases. It is to be noted that inclination angle of the swash plate 5 shown in FIG. 1 corresponds to the maximum inclination angle in the compressor 1.

When the inclination angle of the swash plate 5 is maximum, the restricting surface 50A of the balancing weight 5C is in contact with the rear end of the lug plate 51 at a position that is radially outward of the cylinder chamber 51A. The entry part 50B of the balancing weight 5C is then in the accommodating chamber 51C. The entry part 50B that has entered the accommodating chamber 51C is free from contact with the movable body 13A. Parts of the balancing weight 5C other than the restricting surface 50A and the entry part 50B are also free from contact with the movable body 13A as well.

Figure 5:
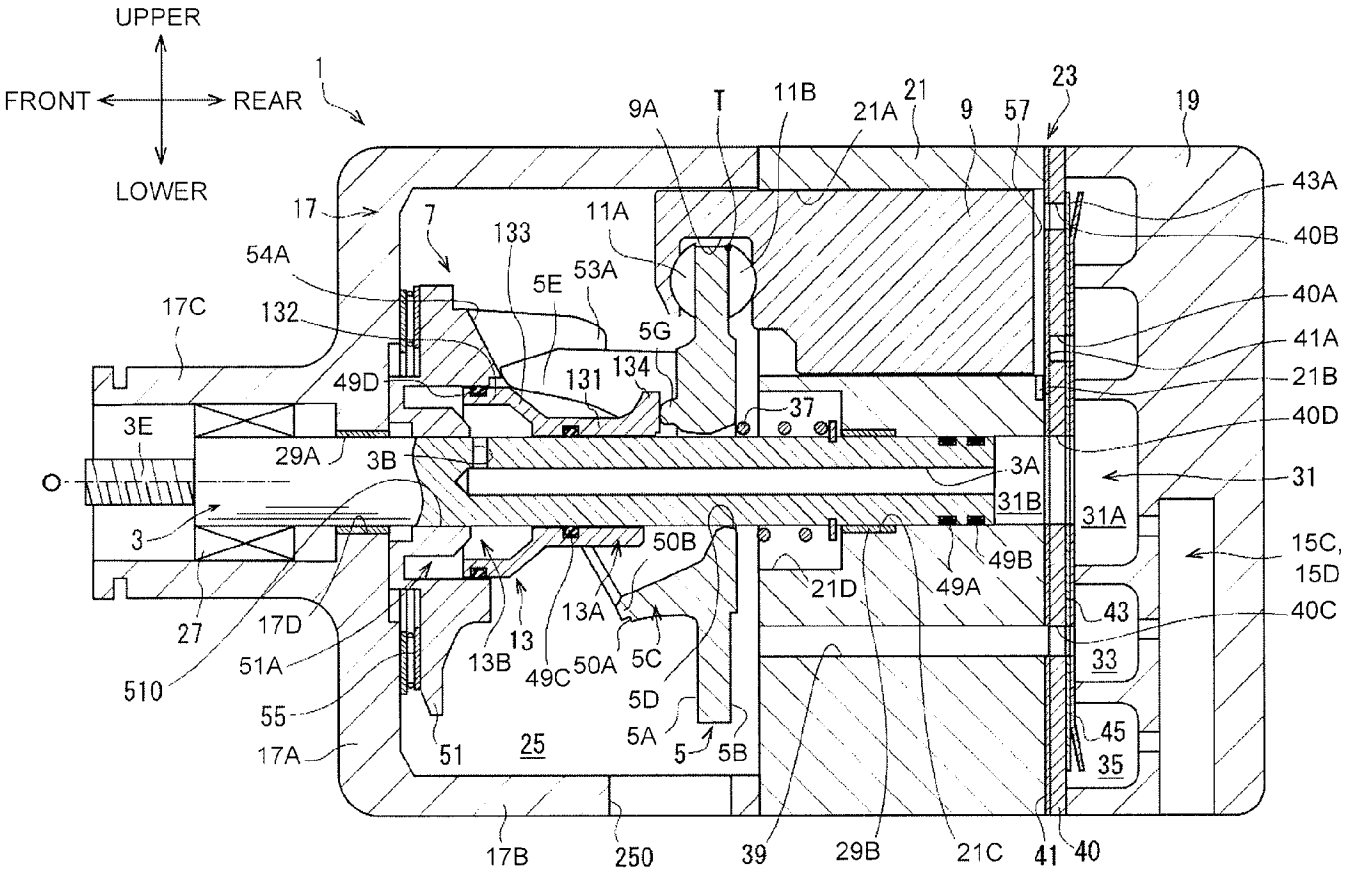
FIG. 5 is a longitudinal sectional view of the compressor according to the first embodiment in a state corresponding to the minimum displacement.

When the opening of the low-pressure passage 15A is reduced by the control valve 15C shown in FIG. 2, the pressure of the pressure regulation chamber 31 increases and therefore the pressure in the pressure control chamber 13B increases. Therefore, as shown in FIG. 5, the volume of the pressure control chamber 13B in the actuator 13 is increased, which causes the movable body 13A to slide in the cylinder chamber 51A away from the lug plate 51, or in the direction of the axis of rotation O toward the swash plate 5. In this case, the volume of the accommodating chamber 51C decreases.

Therefore, the acting part 134 of the movable body 13A pushes the projecting part 5G rearward in the swash plate chamber 25. Then, the first swash plate arm 5E slides on the first slide surface 54A radially inwardly toward the axis of rotation O. The second swash plate arm 5F also slides on the second slide surface 54B radially inwardly toward the axis of rotation O in the same manner as the first swash plate arm 5E.

Therefore, the bottom dead center part of the swash plate 5 rotates counterclockwise as viewed in FIG. 1, while the top dead center position T being maintained, which decreases the inclination angle of the swash plate 5 with respect to the axis of rotation O of the drive shaft 3. Accordingly, the stroke length of the pistons 9 decreases and the displacement of the compressor per one rotation decreases. The swash plate 5 at its reduced inclination angle contacts the return spring 37. It is to be noted that the inclination angle of the swash plate 5 shown in FIG. 5 corresponds to the minimum inclination angle in the compressor. When the swash plate 5 is at its minimum inclination angle, the volume of the accommodating chamber 51C in the cylinder chamber 51A is almost zero.

When the inclination angle of the swash plate 5 is less than the maximum angle, the restricting surface 50A of the balancing weight 5C is free of contact with the lug plate 51, and the entry part 50B moves out from the cylinder chamber 51A.

Because the balancing weight 5C controls the inertia generated by the rotation of the swash plate 5, the swash plate 5 rotates smoothly at any inclination angle thereof. When the inclination angle of the swash plate 5 is maximum, the entry part 50B of the balancing weight 5C is inside the accommodating chamber 51C. The front end of the balancing weight 5C has a surface formed in conformity with and in facing relation to the outline of the connecting part 133 of the movable body 13A, which allows the entry part 50B to enter deep into the accommodating chamber 51C without contacting the movable body 13A. Therefore, the dimension of the compressor in the axial direction may be reduced by the distance for which the entry part 50B moves in entering the accommodating chamber 51C.

In the compressor wherein the restricting surface 50A of the balancing weight 5C is in contact with the lug plate 51 when the inclination angle of the swash plate 5 is maximum, the maximum inclination angle of the swash plate 5 is restricted easily by the balancing weight 5C. With the contacts between the restricting surface 50A and the lug plate 51, between the acting part 134 and the projecting part 5G, between the first swash plate arm 5E and the first slide surface 54A, and between the second swash plate arm 5F and the second slide surface 54B, the lug plate 51 maintains the swash plate 5 at its maximum inclination angle position.

Furthermore, in the compressor wherein the entry part 50B is allowed to enter the accommodating chamber 51C, the size of the balancing weight 5C can be increased to any desired weight, and the accommodating chamber 51C and hence the cylinder chamber 51A is formed in the lug plate 51 with a size that is large enough to accommodate the entry part 50B. Therefore, the diameter of the pressure control chamber 13B can be increased to thereby make possible to reduce the pressure of the pressure control chamber 13B for preferably moving the movable body 13A.

Thus, the compressor according to the first embodiment of the present invention may be made small in size, while exhibiting a high controllability.

Second Embodiment

Figure 6:
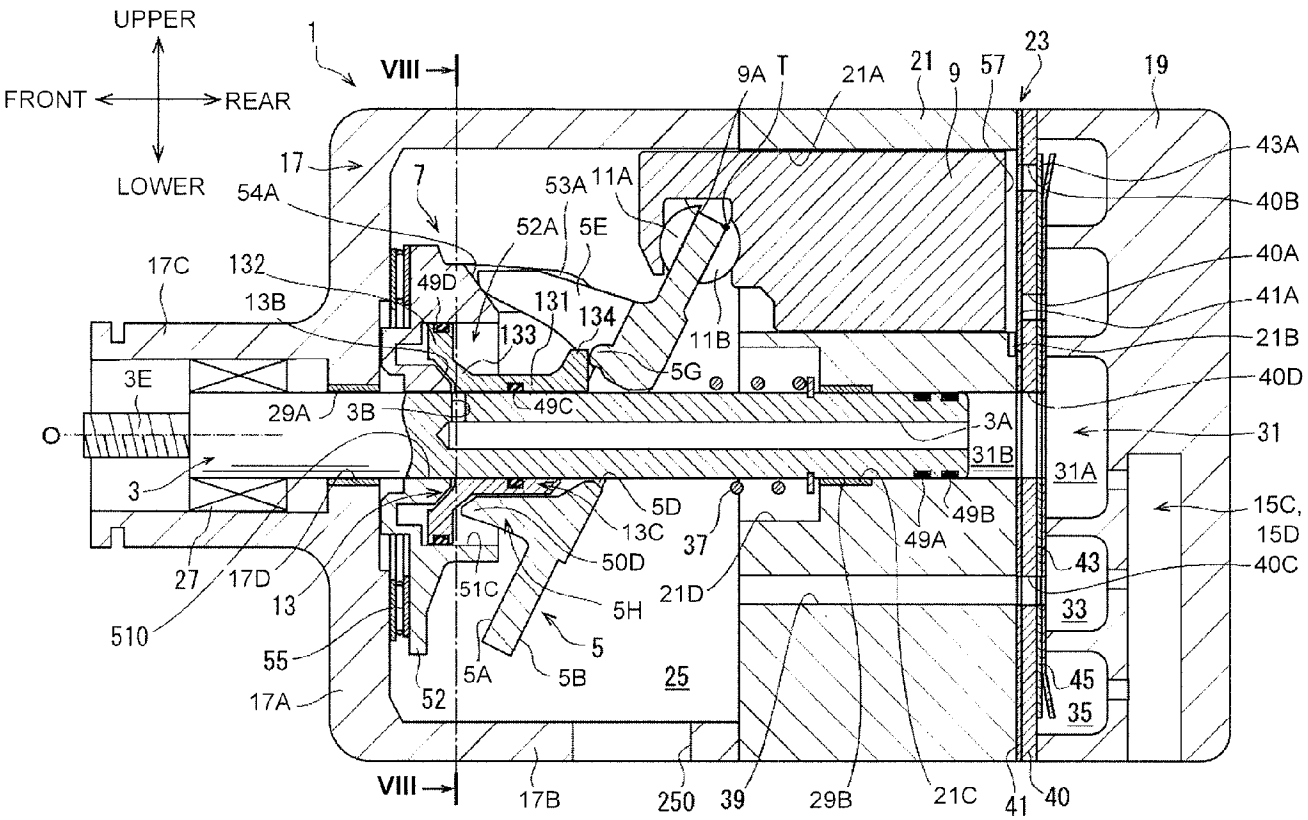
FIG. 6 is a longitudinal sectional view of a compressor according to a second embodiment in a state corresponding to the maximum displacement.

The following will describe the second embodiment of the present invention. As shown in FIG. 6, a compressor according to the second embodiment includes a lug plate 52 and a movable body 13C, instead of the lug plate 51 and a movable body 13A of the compressor of the first embodiment. The lug plate 52 also corresponds to the lug member of the present invention.

The lug plate 52 is press-fitted on the drive shaft 3 for rotation therewith. The lug plate 52 has a recessed, cylindrical cylinder chamber 52A, in addition to the insertion hole 510, first and second drive arms 53A, 53B, and first and second slide surfaces 54A, 54B, which are substantially the same components as the counterparts of the lug plate 51 of the compressor according to the first embodiment. In the compressor according to the second embodiment, the link mechanism 7 includes the lug plate 52, the first and second drive arms 53A, 53B, and first and second swash plate arms 5E, 5F. In the second embodiment, the first and second drive arms, 53A, 53B and the first and second slide surfaces 54A, 54B are formed smaller than the counterparts of the lug plate 51 of the compressor according to the first embodiment.

The cylinder chamber 52A is formed in the lug plate 52 as a recess that surrounds the insertion hole 510 and extends from the rear end surface toward the front end surface of the lug plate 52. The cylinder chamber 52A has a larger diameter than the cylinder chamber 51A of the compressor according to the first embodiment. The cylinder chamber 52A is of a stepped configuration having a large-diameter portion in the rear and a small-diameter portion in the front of the cylinder chamber 52A, respectively. The cylinder chamber 52A is concentric with the lug plate 52 and formed at the center of the lug plate 52.

Figure 7:
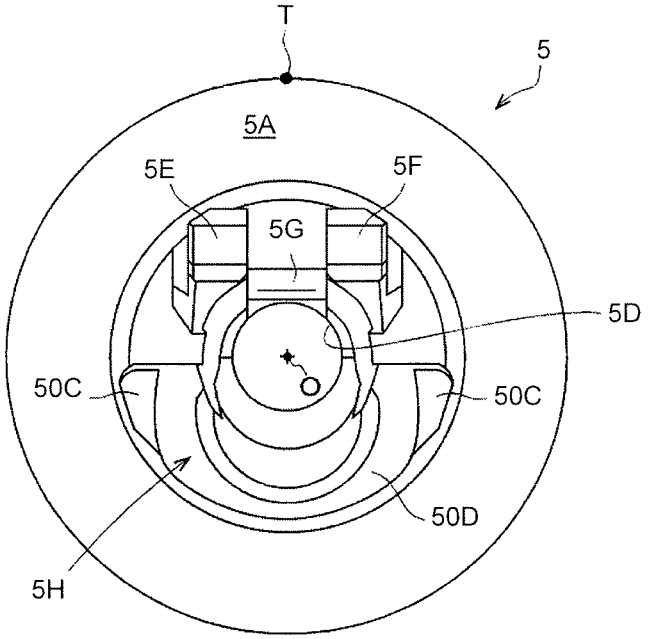
FIG. 7 is a front view of a swash plate of the compressor according to the second embodiment.

As shown in FIG. 7, a balancing weight 5H is formed extending frontward from the front surface of the swash plate 5, instead of the balancing weight 5C of the first embodiment. The balancing weight 5H has a substantially semi-circular cross section as taken in the direction perpendicular to the axial direction of the swash plate 5. The balancing weight 5H is disposed at a position adjacent to the insertion hole 5D and on the side of the axis of rotation O that is opposite to the first and second swash plate arms 5E, 5F. As shown in FIG. 6, with the drive shaft 3 inserted through the insertion hole 5D, the balancing weight 5H is located at a position adjacent to the drive shaft 3 and opposite to the link mechanism 7 with respect to the axis of rotation O.

As shown in FIG. 7, the balancing weight 5H has at the base thereof, that is, at a position adjacent to the front surface 5A of the swash plate 5, a pair of restricting surfaces 50C. The restricting surfaces 50C contact the lug plate 52 when the inclination angle of the swash plate 5 is maximum. The restricting surfaces 50C correspond to the non-entry part of the present invention. The part of the balancing weight 5H which is formed frontward of the restricting surfaces 50C is an entry part 50D.

As shown in FIG. 6, the actuator 13 of the compressor according to the second embodiment includes the lug plate 52, the movable body 13C and the pressure control chamber 13B. Like the movable body 13A in the compressor according to the first embodiment, the movable body 13C is mounted on the drive shaft 3 so as to be slidable in the direction of the axis of rotation O. The movable body 13C has a cylindrical shape that is coaxial with the drive shaft 3 and includes the first cylindrical part 131, the second cylindrical part 132, and a connecting part 133. The movable body 13C has a diameter that is smaller than that of the thrust bearing 55.

As is clear from comparison between FIGS. 1 and 6, the cylinder chamber 52A is formed larger in diameter than the cylinder chamber 51A in the compressor of the first embodiment and the second cylindrical part 132 of the movable body 13C has a diameter that is larger than a counterpart cylindrical part 132 of the movable body 13A. Therefore, the movable body 13C as a whole is larger in diameter than that of the movable body 13A of the first embodiment. As is also clear from FIGS. 1 and 6, the movable body 13C is formed shorter in the longitudinal direction than the movable body 13A of the first embodiment. O-rings 49C, 49D are provided in the inner peripheral surface of the first cylindrical part 131 and the outer peripheral surface of the second cylindrical part 132, respectively.

The balancing weight 5H is formed in conformity with the connecting part 133, as in the case of the first embodiment, so that the diameter is increased toward the front.

The acting part 134 is formed integrally with the movable body 13C at the rear end of the first cylindrical part 131 thereof. The movable body 13C is slidable in the cylinder chamber 52A in the direction of the axis of rotation O. With the second cylindrical part 132 moved into the cylinder chamber 52A, the movable body 13C may be fitted in the lug plate 52.

The movable body 13C defines the pressure control chamber 13B in the cylinder chamber 52A. More specifically, the pressure control chamber 13B is defined in the cylinder chamber 52A by the second cylindrical part 132, the connecting part 133 of the movable body 13C and the drive shaft 3. The space in the cylinder chamber 52A other than the pressure control chamber 13B is an accommodating chamber 51C. The rest of the structure of the compressor according to the second embodiment is substantially the same as that of the compressor according to the first embodiment. Accordingly, the components and elements are referred to using common reference numerals and symbols and, therefore, detailed description thereof will be omitted.

Figure 8:
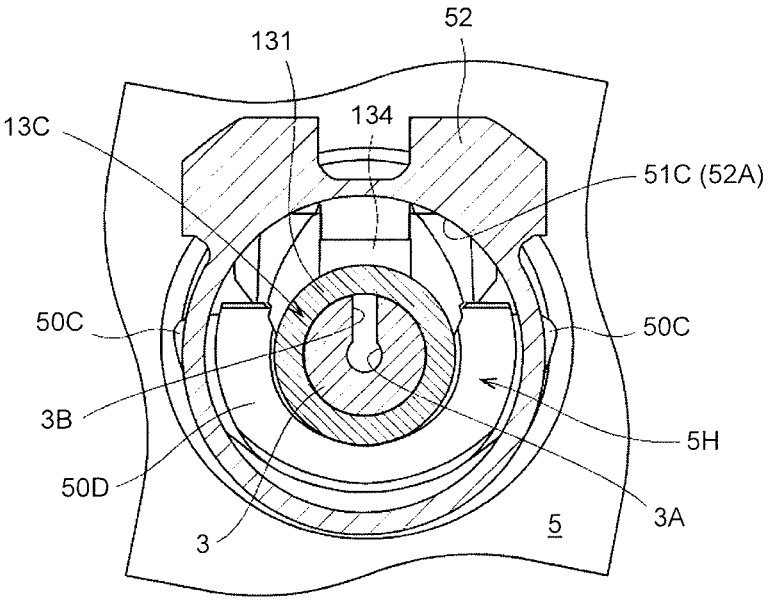
FIG. 8 is an enlarged fragmentary view of the compressor taken along the line VIII-VIII in FIG. 6 according to the second embodiment.

Referring to FIG. 8, in the compressor according to the second embodiment, when the inclination angle of the swash plate 5 is maximum, the restricting surfaces 50C of the balancing weight 5H contact the rear end of the lug plate 52 at positions outward of the cylinder chamber 52A. Therefore, the maximum inclination angle of the swash plate 5 is restricted by the balancing weight 5H.

The entry part 50D of the balancing weight 5H enters into the accommodating chamber 51C. As shown in FIG. 6, in the compressor, the entry part 50D that is inserted in the accommodating chamber 51C is free from contact with the movable body 13C. Furthermore, parts of the balancing weight 5H other than the restricting surfaces 50C and the entry part 50D are free from contact with the movable body 13C as well.

Furthermore, in the compressor, when the inclination angle of the swash plate 5 is less than the maximum, the restricting surfaces 50C of the balancing weight 5H is free from contact with the lug plate 52, and the entry part 50D moves out from the accommodating chamber 51C.

In the compressor according to the second embodiment, the contact surfaces 50C are formed projecting radially outward of the balancing weight 5H. Furthermore, the restricting surfaces 50C are formed at the base of the balancing weight 5H. Therefore, the entry part 50D in the compressor according to the second embodiment is larger than the entry part 50B in the compressor of the first embodiment, which allows the balancing weight 5H to move into the cylinder chamber 52A deeper into the accommodating chamber 51C than in the case of the compressor according to the first embodiment. The front end of the balancing weight 5H being formed in conformity with the connecting part 133 of the movable body 13C also allows the entry part 50D to enter the accommodating chamber 51C deeper without contacting the movable body 13C.

In the compressor according to the second embodiment, the entry part 50D enters the accommodating chamber 51C before the restricting surfaces 50C are brought into contact with the rear end of the lug plate 52. Therefore, when the inclination angle of the swash plate 5 is increased to a predetermined angle, the entry part 50D starts to enter the accommodating chamber 51C before the inclination angle reaches the maximum angle. Even in the state in which the inclination angle of the swash plate 5 is less than the maximum angle and the restricting surfaces 50C do not contact the lug plate 52, the entry part 50D remains in the accommodating chamber 51C until the inclination angle is reduced to a predetermined angle. Therefore, the dimension in the axial direction of the compressor according to the second embodiment can be smaller than that of the compressor according to the first embodiment.

Additionally, the compressor according to the second embodiment wherein the diameter of the cylinder chamber 52A is larger than the diameter of the cylinder chamber 51A of the compressor according to the first embodiment, the diameter of the pressure control chamber 13B can be increased with the result that the pressure of the pressure control chamber 13 for moving the movable body 13C can be reduced. Other effects of the compressor according to the second embodiment are the same as those of the compressor according to the first embodiment.

Third Embodiment

Figure 9:
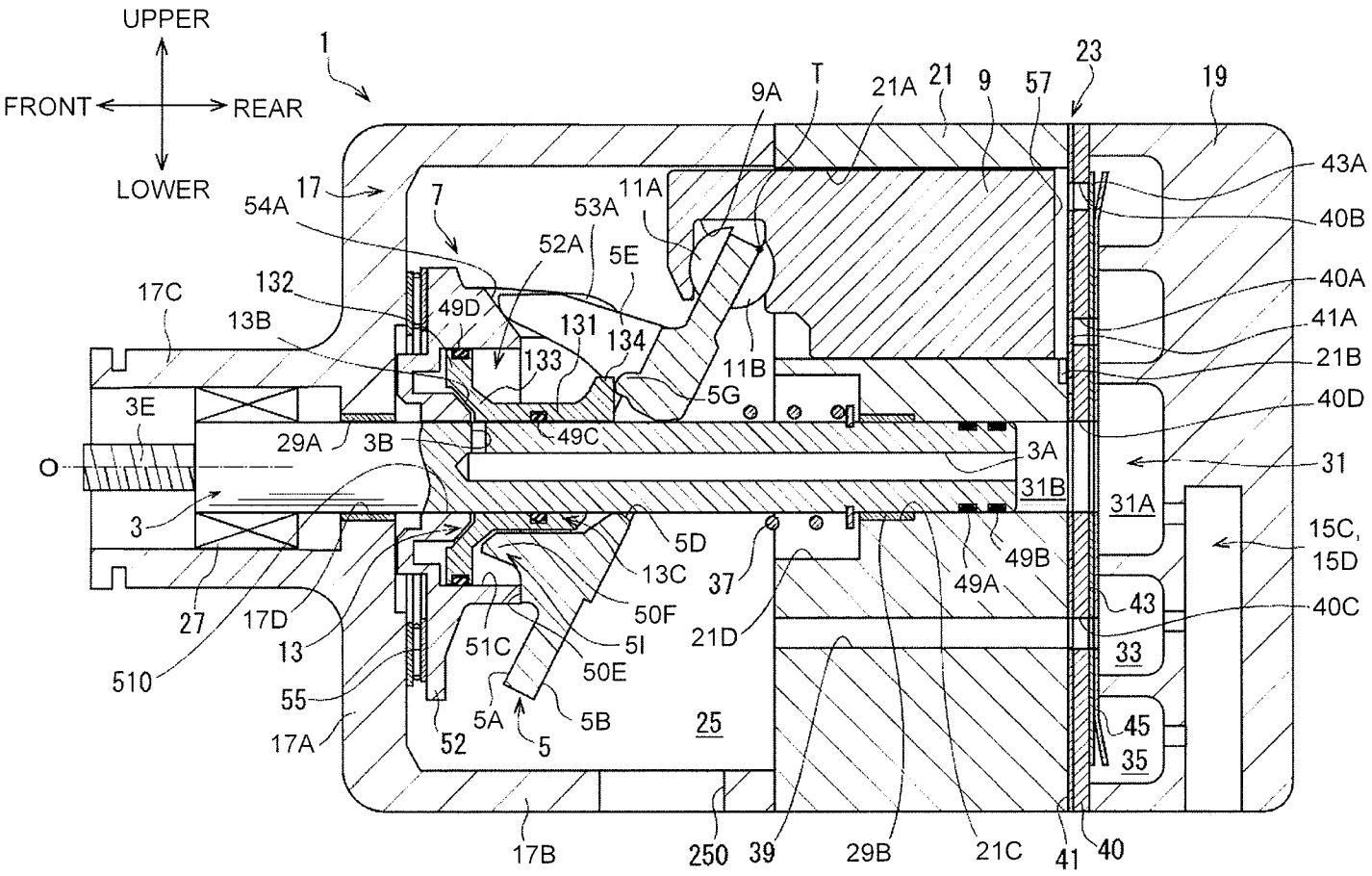
FIG. 9 is a longitudinal sectional view of a compressor according to a third embodiment in a state corresponding to the maximum displacement.

The following will describe the third embodiment of the present invention with reference to FIG. 9. As shown in the drawing, a compressor according to the third embodiment differs from the compressor according to the second embodiment in that the swash plate 5 is formed with a balancing weight 5I instead of the balancing weight 5H of the second embodiment.

Similar to the balancing weights 5C, 5H in the first and second embodiments, the balancing weight 5I projects frontward from the front surface 5A of the swash plate 5. Furthermore, the balancing weight 5I has a semi-circular cross section taken in a plane perpendicular to the axial direction of the swash plate 5. The balancing weight 5I is disposed at a position that is adjacent to the insertion hole 5D and opposite to first and second swash plate arms 5E, 5F with respect to the axis of rotation O. Accordingly, with the drive shaft 3 inserted through the insertion hole 5D of the swash plate 5, the balancing weight 5I is located at a position that is adjacent to the drive shaft 3 and opposite to the link mechanism 7 with respect to the axis of rotation O.

The balancing weight 5I has at the base thereof a planar restricting surface 50E. The restricting surface 50E is in contact with a lug plate 52 when the inclination angle of the swash plate 5 is maximum. The restricting surface 50E corresponds to the non-entry part of the present invention. The balancing weight 5I is formed in conformity with the connecting part 133 and the diameter of the front end part thereof is increased toward the front. The rest of the configuration of the compressor according to the third embodiment is substantially the same as that of the compressor according to the second embodiment.

In the compressor according to the third embodiment, the maximum inclination angle of the swash plate 5 is defined by the contact of the restricting surface 50E of the balancing weight 5I with the rear end of the lug plate 52 that is radially outward of the cylinder chamber 52A.

An entry part 50F of the balancing weight 5I is movable into an accommodating chamber 51C. The front end of the balancing weight 5I is formed in conformity with the movable body 13C, which allows the entry part 50F to enter deep into the accommodating chamber 51C without contacting the movable body 13C. Parts of the balancing weight 5I other than the restricting surface 50E and the entry part 50F are free from contact with the movable body 13C.

In the compressor according to the third embodiment, when the inclination angle of the swash plate 5 is less than the maximum angle, the restricting surface 50E of the balancing weight 5I is free from contact with the lug plate 52. When the inclination angle is reduced to a specified angle, the entry part 50F moves out from the accommodating chamber 51C.

In the compressor according to the third embodiment wherein the balancing weight 5I has at the base thereof the restricting surface 50E, the entry part 50F of the swash plate 5 may be formed large enough to allow the balancing weight 5I to enter deep into the accommodating chamber 51C. Other effects of the compressor according to the third embodiment are the same as those of the compressors according to the first and second embodiments.

Fourth Embodiment

Figure 10:
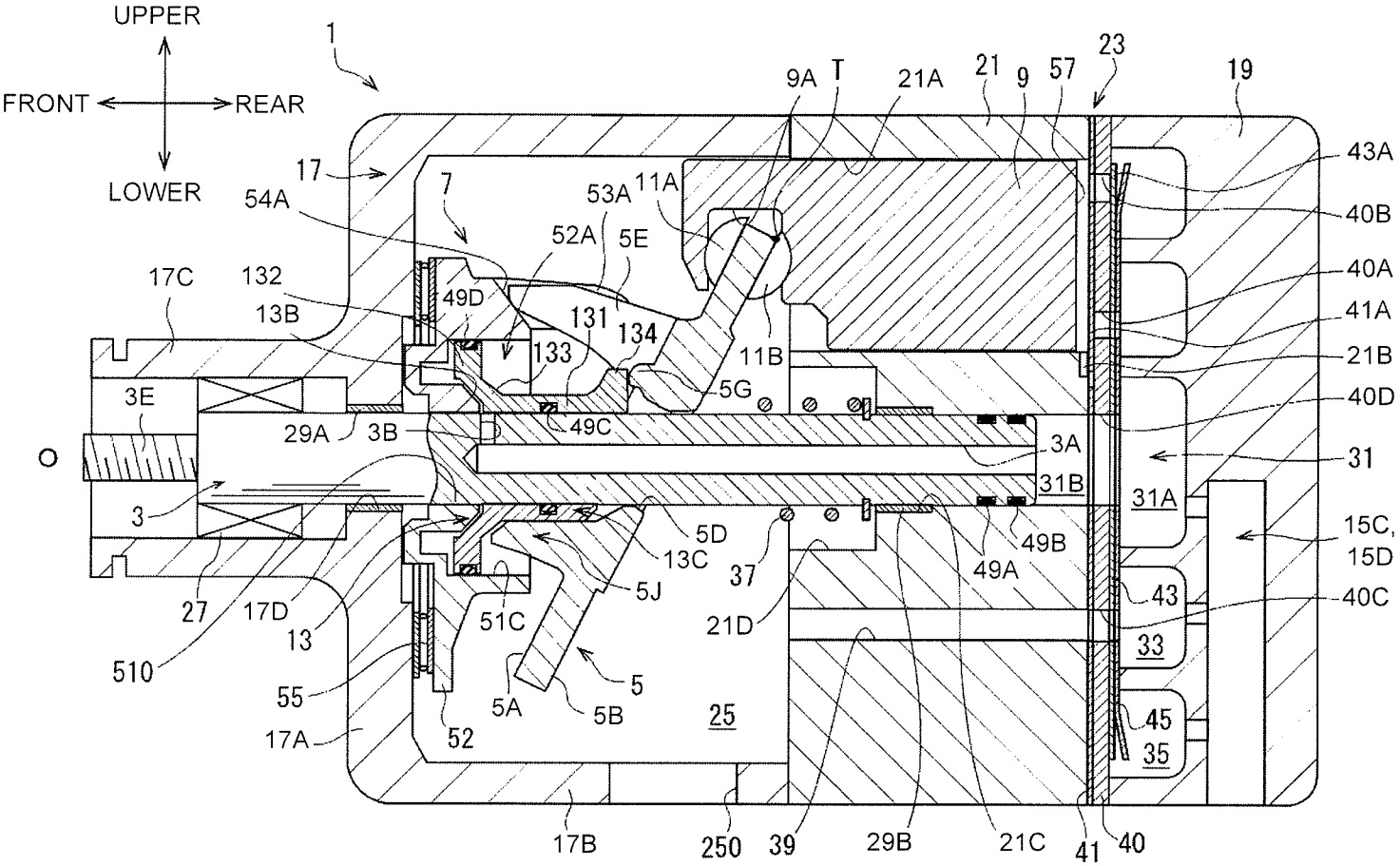
FIG. 10 is a longitudinal sectional view of a compressor according to a fourth embodiment in a state corresponding to the maximum displacement.

The following will describe the fourth embodiment of the present invention with reference to FIG. 10. As shown in the drawing, a compressor according to the fourth embodiment differs from the compressor according to the second embodiment in that the swash plate 5 has a balancing weight 5J instead of the balancing weight 5H of the second embodiment.

Similar to the balancing weights 5C, 5H, and 5I of the first, second and third embodiments, the balancing weight 5J is formed projecting from the front surface 5A of the swash plate 5. The balancing weight 5J has a semi-circular cross section taken in a plane perpendicular to the axial direction of the swash plate 5. The balancing weight 5J is disposed at a position adjacent to the insertion hole 5D of the swash plate 5 and opposite to the first and second swash plate arms 5E, 5F with respect to the axis of rotation O. With the drive shaft 3 inserted through the insertion hole 5D, the balancing weight 5J is located at a position adjacent to the drive shaft 3 and opposite to a link mechanism 7 with respect to the axis of rotation O.

The balancing weight 5J is formed in conformity with the connecting part 133 and the diameter of the front end part thereof is increased toward the front. Unlike the balancing weights 5C, 5H, and 5I of the preceding embodiments, the balancing weight 5J does not have a restricting surface like such as 50A, 50C and 50E. The rest of the configuration of the compressor according to the fourth embodiment is substantially the same as that of the compressor according to the second embodiment.

Similar to the compressor according to the second embodiment, when the inclination angle of the swash plate 5 increases to a predetermined angle in the compressor according to the fourth embodiment, the balancing weight 5J starts to enter an accommodating chamber 51C before the inclination angle reaches the maximum angle. When the inclination angle of the swash plate 5 is maximum, an inner peripheral surface of the balancing weight 5J is in contact with an outer peripheral surface of the first cylindrical part 131. More specifically, the inner peripheral surface of the balancing weight 5J is brought into line contact with the outer peripheral surface of the first cylindrical part 131. The balancing weight 5J thus restricts the maximum inclination angle of the swash plate 5. With the balancing weight 5J moved into the accommodating chamber 51C, other parts of the balancing weight 5J than the peripheral surface thereof are free from contact with the movable body 13C, and the balancing weight 5J is also free from contact with a lug plate 52.

In the compressor according to the fourth embodiment, with the swash plate 5 inclined at an angle less than the maximum angle, the inner peripheral surface of the balancing weight 5J is free from contact with the outer peripheral surface of the first cylindrical part 131. When the inclination angle of the swash plate 5 is reduced to a predetermined angle, the balancing weight 5J moves out from the accommodating chamber 51C.

The front end of the balancing weight 5J of the compressor according to the fourth embodiment is formed in conformity with the connecting part 133 of the movable body 13C, which allows the balancing weight 5J to enter deep into the accommodating chamber 510. The maximum inclination angle of the swash plate 5 is determined by the contact of the inner peripheral surface of the balancing weight 5J with the outer peripheral surface of the first cylindrical part 131. The surface contact of the inner peripheral surface of the balancing weight 5J with the outer peripheral surface of the first cylindrical part 131 increases the area of the contact surface between the balancing weight 5J and the movable body 13C. Therefore, the contact pressure acting on the balancing weight 5J then in contact with the movable body 13C may be reduced. Other effects of the compressor according to the fourth embodiment are substantially the same as those of the compressors according to the first and second embodiments.

Although the present invention has been described in the context of the first to fourth embodiments, the present invention is not limited to such embodiments, but may appropriately be modified within the scope of the invention.

The present invention is applicable to an air conditioning system.

What is claimed is:

1. A swash plate type variable displacement compressor comprising:

a housing having therein a suction chamber, a discharge chamber, a swash plate chamber, and a plurality of cylinder bores;

a drive shaft rotatably supported in the housing and having an axis of rotation; a swash plate that is rotatable in the swash plate chamber with the drive shaft;

a link that is disposed between the drive shaft and the swash plate and allows a change in an inclination angle of the swash plate with respect to a plane extending perpendicularly to the axis of rotation of the drive shaft;

a plurality of pistons that is reciprocally movably received in the respective cylinder bores;

a converter that engages the swash plate with the plurality of pistons such that the rotation of the swash plate is converted into reciprocal movement of the pistons in the respective cylinder bores with a stroke length according to the inclination angle of the swash plate;

an actuator that changes the inclination angle of the swash plate; and a controller that controls the actuator, wherein the actuator includes a lug member that is fixed on the drive shaft in the swash plate chamber that is opposed to the swash plate, and a movable body disposed between the lug member and the swash plate, the lug member has an insertion hole through which the drive shaft is inserted, and a cylinder chamber that is recessed from the swash plate side of the lug member in such a manner as to surround the insertion hole, the movable body is slidably mounted on the drive shaft in the cylinder chamber in the direction of an axis of rotation such that the movable body is coaxial with the drive shaft, the movable body is slidable in accordance with the change in the inclination angle of the swash plate between a minimum inclination angle and a maximum inclination angle, a pressure control chamber is formed between the cylinder chamber and the movable body and moves the movable body with pressure in the pressure control chamber, the swash plate has a balancing weight on the side opposite to the link with respect to the axis of rotation, the cylinder chamber has an accommodating chamber that is opened toward the swash plate as the movable body moves in the direction that reduces the volume of the pressure control chamber with an increase in the inclination angle of the swash plate, the accommodating chamber is defined by a movable range of the movable body in contact with the cylinder chamber between the minimum inclination angle of the swash plate and the maximum inclination angle of the swash plate, and at least a part of the balancing weight is inserted in the accommodating chamber of the cylinder chamber when the swash plate is at the maximum inclination angle.

2. The swash plate type variable displacement compressor according to claim 1, wherein the balancing weight restricts the maximum inclination angle of the swash plate.

3. The swash plate type variable displacement compressor according to claim 2, wherein the balancing weight has a non-entry part that does not enter the accommodating chamber, and the non-entry part is in contact with the lug member when the inclination angle of the swash plate is maximum.

4. The swash plate type variable displacement compressor according to claim 2, wherein the balancing weight is in contact with the movable body when the inclination angle of the swash plate is maximum.

5. The swash plate type variable displacement compressor according to claim 1, wherein the movable body includes a first cylindrical part disposed on the swash plate side, a second cylindrical part that has a diameter that is larger than diameter of the first cylindrical part, and a connecting part that connects the first cylindrical part to the second cylindrical part, and the balancing weight is formed in conformity with the connecting part.

6. The swash plate type variable displacement compressor according to claim 1, wherein the movable body is integrally rotatable with the lug member and the swash plate.

7. The swash plate type variable displacement compressor according to claim 1, wherein the balancing weight is substantially semi-circular in cross section when viewed from a direction perpendicular to the direction of the axis of rotation.

8. The swash plate type variable displacement compressor according to claim 1, wherein the lug member includes first and second drive arms, the swash plate includes first and second plate arms disposed between the first and second drive arms, and when the drive shaft is rotated, the first and second drive arms transmit rotation of the drive shaft to drive the first and second plate arms to rotate in the swash plate chamber with the lug member.

9. The swash plate type variable displacement compressor according to claim 1, wherein the inclination angle of the swash plate decreases as the pressure in the pressure control chamber increases.

10. The swash plate type variable displacement compressor according to claim 1, wherein the link includes the lug member, and the lug member is fixed on the drive shaft in the swash plate chamber that is opposed to the swash plate.

* * * * *